US008438972B2

(12) United States Patent
Cotter

(10) Patent No.: US 8,438,972 B2
(45) Date of Patent: May 14, 2013

(54) COOKIE SUPPORT SYSTEM

(76) Inventor: Mark E. Cotter, Seffner, FL (US)

( * ) Notice: Subject to any disclaimer, the term of this patent is extended or adjusted under 35 U.S.C. 154(b) by 742 days.

(21) Appl. No.: 12/456,367

(22) Filed: Jun. 16, 2009

(65) Prior Publication Data

US 2010/0181331 A1 Jul. 22, 2010

Related U.S. Application Data

(63) Continuation of application No. 11/343,432, filed on Jan. 31, 2006, now Pat. No. 7,552,674.

(51) Int. Cl.

| | |
|---|---|
| ***B65D 6/28*** | (2006.01) |
| ***B65D 8/18*** | (2006.01) |
| ***A47G 21/18*** | (2006.01) |
| ***A61J 7/00*** | (2006.01) |

(52) U.S. Cl.
USPC ..... 99/426; 239/33; 248/324; 248/333; 220/4.25; 220/4.22; 220/705

(58) Field of Classification Search ..... 99/426, 99/440; 239/33; 248/324, 326, 333; 220/4.22, 220/4.25, 4.24, 705
See application file for complete search history.

(56) References Cited

U.S. PATENT DOCUMENTS

| | | | | |
|---|---|---|---|---|
| 1,272,318 | A | 7/1918 | Rodgers | 99/342 |
| 3,759,163 | A | 9/1973 | Walker | 99/336 |
| 4,273,249 | A | 6/1981 | Florian | 220/4.25 |
| 6,503,222 | B2 | 1/2003 | Lo | 604/77 |
| 7,077,054 | B1 * | 7/2006 | Hurlock | 99/323 |
| 7,591,219 | B2 * | 9/2009 | Saha | 99/323 |
| 2001/0042754 | A1 * | 11/2001 | Lei | 220/705 |
| 2005/0012350 | A1 * | 1/2005 | Kelsey | 294/118 |
| 2006/0021990 | A1 * | 2/2006 | Friedman | 220/703 |

* cited by examiner

*Primary Examiner* — Reginald L Alexander

(57) ABSTRACT

A cookie support system has a lower component, an upper component, and a coupling component. The lower component includes an elongated first section having a hollow cylindrical portion configured for sipping a liquid by a user and a second section coupled to the first section and having parallel side walls with an open top portion and a bottom portion configured for receiving a cookie. The bottom portion is formed of an arcuate face coupling the side walls. The upper component includes a first section formed of parallel side walls with an open bottom portion and a top portion formed of an arcuate face coupling the side walls. An elongated second section is coupled to and protruding from the first section. A coupling component between the lower and upper components is configured to thereby open and separate the lower and upper components for positioning a cookie there between.

17 Claims, 3 Drawing Sheets

FIG 3
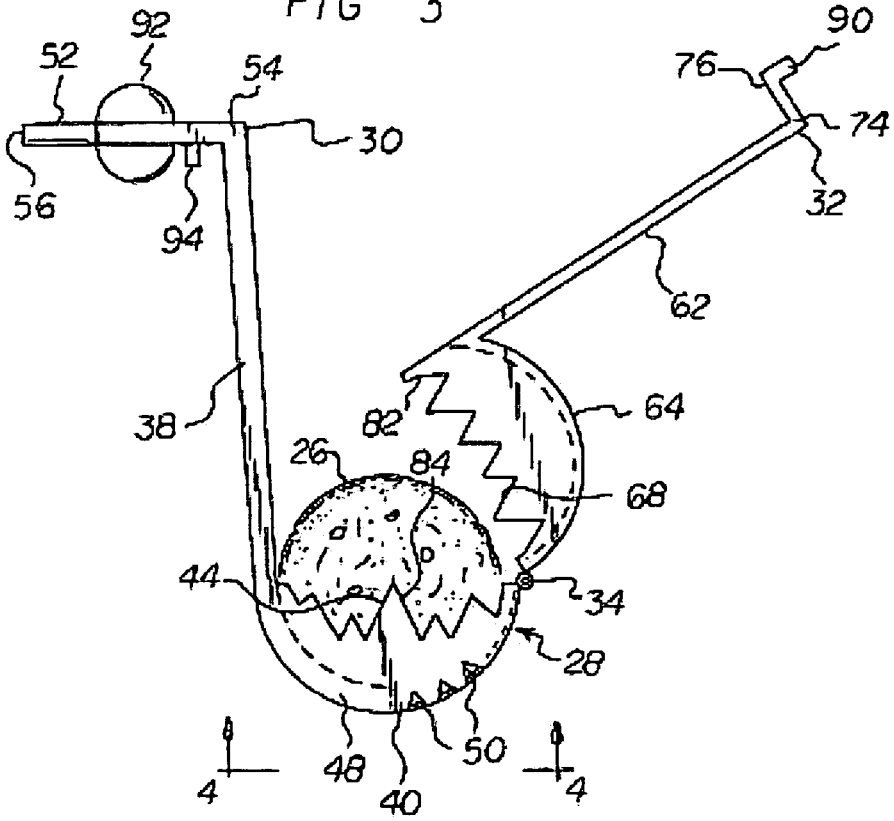
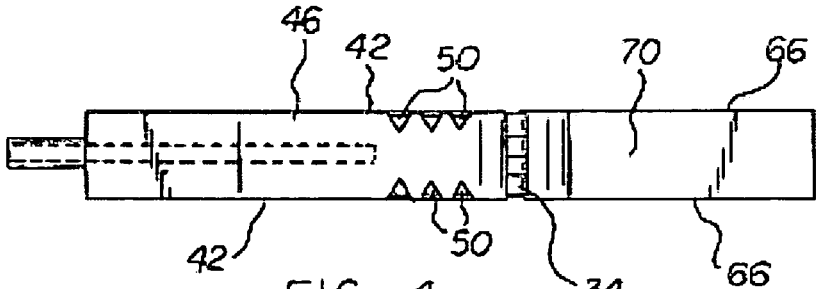
FIG 4

COOKIE SUPPORT SYSTEM

CROSS-REFERENCE TO RELATED APPLICATIONS

The present application is a continuation of U.S. patent application Ser. No. 11/343,432, filed Jan. 31, 2006 now U.S. Pat. No. 7,552,674, which is incorporated herein by reference in its entirety.

BACKGROUND OF THE INVENTION

1. Field of the Invention

The present invention relates to a cookie support system and more particularly pertains to holding a cookie submerged in a glass of milk while sipping milk with cookie particles in suspension.

2. Description of the Prior Art

The use of support systems of known designs and configurations is known in the prior art. More specifically, support systems of known designs and configurations previously devised and utilized for the purpose of supporting items through known methods and apparatuses are known to consist basically of familiar, expected, and obvious structural configurations, notwithstanding the myriad of designs encompassed by the crowded prior art which has been developed for the fulfillment of countless objectives and requirements.

In this respect, the cookie support system according to the present invention substantially departs from the conventional concepts and designs of the prior art, and in doing so provides an apparatus primarily developed for the purpose of holding a cookie submerged in a glass of milk while sipping milk with cookie particles in suspension.

Therefore, it can be appreciated that there exists a continuing need for a new and improved cookie support system which can be used for holding a cookie submerged in a glass of milk while sipping milk with cookie particles in suspension. In this regard, the present invention substantially fulfills this need.

BRIEF SUMMARY OF THE INVENTION

In view of the foregoing disadvantages inherent in the known types of support systems of known designs and configurations now present in the prior art, the present invention provides an improved cookie support system. As such, the general purpose of the present invention, which will be described subsequently in greater detail, is to provide a new and improved cookie support system and method which has all the advantages of the prior art and none of the disadvantages.

To attain this, embodiments of the present invention ijnclude a cookie support system. First provided is a glass. The glass has a closed bottom. The glass has a open top. The glass has a side wall. The side wall is provided between the top and the bottom. The side wall has a circular cross section. The side wall's smallest diameter is adjacent to the bottom.

A quantity of milk is provided. The milk is provided within the glass. The milk is adapted to be consumed by a user through sipping.

Provided next is a cookie. The cookie has a cookie support assembly. The cookie support assembly has a lower component. The cookie support assembly has an upper component. The cookie component has a hinge. The hinge is provided between the upper component and the lower component.

The lower component has a central section. The central section is in a hollow cylindrical configuration. The central section is generally vertically disposed during operation and use. The lower component has lower section. The lower section has a semi-circular lower edge. The lower edge is formed of parallel side walls. The lower section has an open top. The lower section has a closed bottom. The closed bottom is formed of an arcuate face. The arcuate face couples the side walls. In this manner a lower chamber is formed. The lower section has an interior quadrant. The interior quadrant has a hollow segment. The hollow segment is formed as an extension of the central section. The lower section also has an exterior quadrant. The exterior quadrant has apertures. The apertures are provided adjacent to the arcuate face. In this manner milk is allowed to flow through the apertures. The lower component has an upper section. The upper section is horizontally oriented above the open top of the glass. The upper section has an interior end. The interior end is formed as an extension of the hollow central section of the lower component. The upper section has an exterior end. The exterior end is adapted to be held in the lips of a user for sipping and drinking milk being received from the hollow segment of the lower section and the central section and the of the upper section of the lower component.

The upper component has a central section. The central section is generally vertically disposed during operation and use. The upper component has a lower section. The lower section has semi-circular upper edges. The upper edges are formed of parallel side walls. The side walls have an open bottom. The side walls have a closed top. The closed top is formed of an arcuate face. The arcuate face couples the side walls. In this manner an upper chamber is formed. The upper section has an interior quadrant. The interior quadrant is formed as an extension of the central section. The upper section also has an exterior quadrant. The upper component has an upper section. The upper section is horizontally oriented above the upper component of the lower component, the open top of the glass. The upper section has an interior end. The interior end is formed as an extension of the central section of the upper component. The upper section further has an exterior end.

A hinge is provided next. The hinge is secured between and rotatably couples the exterior quadrants of the lower and upper segments. In this manner the lower and upper chambers may be opened and separated for positioning the cookie therein and to thereby close and join the lower and upper chambers for securing a cookie in position between the upper and lower components.

Further provided are serrations. The serrations simulate teeth and eyes. The teeth are formed in the open top of the lower component and the open bottom of the upper component. The eyes are formed in the upper component above the serrations. In this manner a visual appearance of a monster is given.

Provided next are positioning elements. The positioning elements include an upwardly extending lip. The upwardly extending lip assists a user in manipulating the lower and upper components. The positioning elements include a spherical member. The spherical member is provided at a central extent of the upper section of the lower component. In this manner the central section of the lower component is retained on the open top of the glass. There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining the embodiments of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an aspect of the present invention to provide a new and improved cookie support system which has all of the advantages of the prior art support systems of known designs and configurations and none of the disadvantages.

It is another aspect of the present invention to provide a new and improved cookie support system which may be easily and efficiently manufactured and marketed.

It is further aspect of the present invention to provide a new and improved cookie support system which is of durable and reliable constructions.

An even further aspect of the present invention is to provide a new and improved cookie support system which is susceptible of a low cost of manufacture with regard to both materials and labor, and which accordingly is then susceptible of low prices of sale to the consuming public, thereby making such cookie support system economically available to the buying public.

Even still another aspect of the present invention is to provide a cookie support system for holding a cookie submerged in a glass of milk while sipping milk with cookie particles in suspension.

A specific embodiment of the present invention provides a new and improved cookie support system. A lower component has a vertical central section and a lower section. The lower component is formed of parallel side walls. The lower component has an open top and a closed bottom. The bottom is formed of an arcuate face. The arcuate face couples the side walls. The lower component has a horizontal upper section. The upper component has a vertical central section and a lower section. The upper component is formed of parallel side walls. The upper component has an open bottom and a closed top. The top is formed of an arcuate face. The arcuate face couples the side walls. The upper component has a horizontal upper section. Coupling components are provided between the lower and upper components. In this manner the lower and upper components may be opened and separated for positioning a cookie there between.

Another embodiment of the invention provides a cookie support system having a lower component, an upper component, and a coupling component. The lower component includes an elongated first section having a hollow cylindrical portion configured for sipping a liquid by a user and a second section coupled to the first section and having parallel side walls with an open top portion and a bottom portion configured for receiving a cookie. The bottom portion is formed of an arcuate face coupling the side walls. The upper component includes a first section formed of parallel side walls with an open bottom portion and a top portion formed of an arcuate face coupling the side walls. An elongated second section is coupled to and protruding from the first section. A coupling component between the lower and upper components is configured to thereby open and separate the lower and upper components for positioning a cookie there between.

In an embodiment of the cookie support system described above, the hollow segment of the lower component includes a straw. In another embodiment, the lower component further comprises one or more apertures configured to allow the liquid to flow there through. In another embodiment, the coupling component is configured to rotatably couple the lower component and the upper component. In another embodiment, the coupling component includes a hinge. In another embodiment, the coupling component is configured to slidably couple the lower component and the upper component. In another embodiment, the coupling component is configured to allow at least a portion of the upper component to be slidably received in the lower component.

An alternative embodiment of the invention provides cookie support system that includes a holding component, a cover component, and a coupling component. The holding component has an elongated first section coupled with a curved second section configured for receiving a cookie. The second section has parallel side walls with a bottom portion formed of an arcuate face coupling the side walls. The second section also has one or more apertures. The cover component includes a curved first section having an arcuate face configured for covering a top portion of the cookie. The cover component also has a second section coupled to and protruding from the curved first section. The coupling component is configured to displace the cover component with respect to the holding component for positioning the cookie there between.

In an embodiment of the cookie support system described above, the holding component also has a hollow cylindrical portion configured for sipping a liquid by a user. In another embodiment, the holding component also includes a straw. In another embodiment, the holding component is configured to hold a straw. In another embodiment, the one or more apertures in the holding component are configured to allow a liquid to flow there through. In another embodiment, the cover component also has parallel side walls disposed on either sides of the arcuate face. In another embodiment, the coupling component is configured to rotatably couple the holding component and the cover component. In another embodiment, the coupling component comprises a hinge. In another embodiment, the coupling component is configured to slidably couple the holding component and the cover component. In another embodiment, the coupling component is configured to allow at least a portion of the cover component to be slidably received in the holding component.

Yet another embodiment of the invention provides a cookie support assembly that includes a lower component, an upper component, and a hinge coupling between the upper component and the lower component. The lower component has a central section including a portion in a hollow cylindrical configuration generally vertically disposed during operation and use. The lower component having a lower section with semi-circular lower edge formed of parallel side walls with an open top and a bottom formed of an arcuate face coupling the side walls to form a lower chamber, the lower section having one or more apertures to allow a liquid to flow there through. The lower component has an upper section with an exterior end adapted to be held in the lips of a user for sipping and drinking the liquid. The upper component has a first section generally vertically disposed during operation and use. The upper component has a second section with semi-circular upper edges formed of parallel side walls with an open bottom and a closed top formed of an arcuate face coupling the side walls to form an upper chamber. The hinge is secured between and rotatably coupling the lower and upper components to thereby open and separate the lower and upper chambers for positioning a cookie therein and to thereby close and join the lower and upper chambers for securing a cookie in position between the upper and lower components.

For a better understanding of additional details of the various features of the invention, its operating advantages, and the specific benefits that can be attained by its uses, reference should be made to the accompanying drawings and descriptions.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a front elevational view similar to FIG. 1 but with the glass of milk removed and with the support assembly in the open orientation.

FIG. 4 is a bottom view of the system taken along line 4-4 of FIG. 3.

The same reference numerals refer to the same parts throughout the various Figures.

DETAILED DESCRIPTION OF THE PREFERRED EMBODIMENTS

Figure 1:
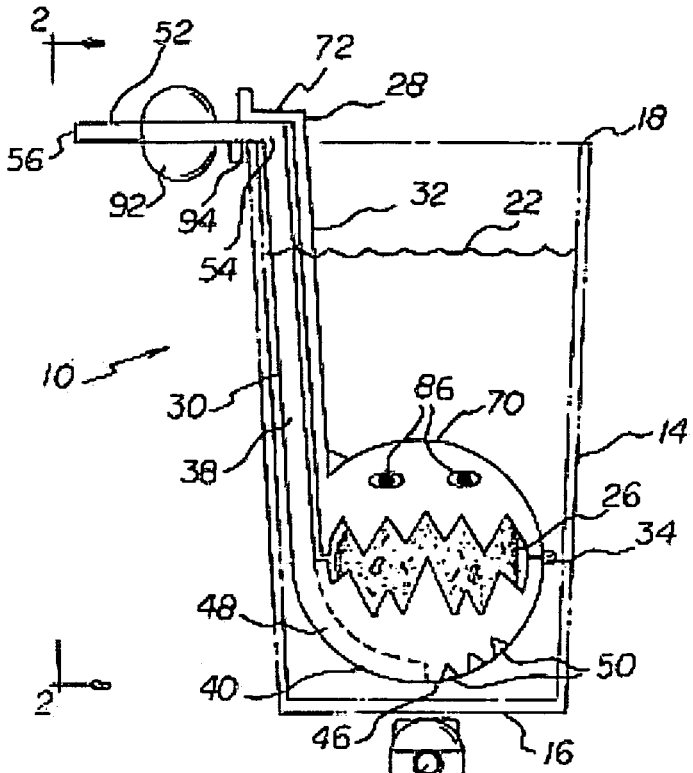
FIG. 1 is a side elevational view of a cookie support system constructed in accordance with an embodiment of the present invention.
Figure 2:
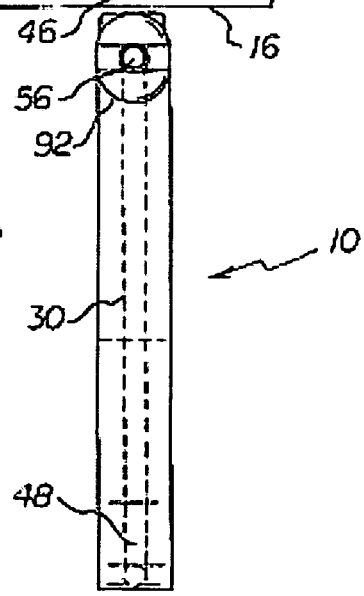
FIG. 2 is a side elevational view of the system taken along line 2-2 of FIG. 1.

With reference now to the drawings, and in particular to FIG. 1 thereof, the preferred embodiment of the new and improved cookie support system embodying the principles and concepts of the present invention and generally designated by the reference numeral 10 will be described.

The present invention, the cookie support system 10 is comprised of a plurality of components. Such components in their broadest context include a lower component, and upper component and coupling components. Such components are individually configured and correlated with respect to each other so as to attain the desired objective.

First provided is a glass 14. The glass has a closed bottom 16. The glass has a open top 18. The glass has a side wall. The side wall is provided between the top and the bottom. The side wall has a circular cross section. The side wall's smallest diameter is adjacent to the bottom.

A quantity of milk 22 is provided. The milk is provided within the glass. The milk is adapted to be consumed by a user through sipping.

Provided next is a cookie 26. The cookie is provided with a cookie support assembly 28. The cookie support assembly has a lower component 30. The cookie support assembly has an upper component 32. The cookie component has a hinge 34. The hinge is provided between the upper component and the lower component.

The lower component 30 has a central section 38. The central section is in a hollow cylindrical configuration. The central section is generally vertically disposed during operation and use. The lower component has lower section 40. The lower section has a semi-circular lower edge. The lower edge is formed of parallel side walls 42. The lower section has an open top 44. The lower section has a closed bottom. The closed bottom is formed of an arcuate face 46. The arcuate face couples the side walls. In this manner a lower chamber is formed. The lower section has an interior quadrant. The interior quadrant has a hollow segment 48. The hollow segment is formed as an extension of the central section. The lower section also has an exterior quadrant. The exterior quadrant has apertures 50. The apertures are provided adjacent to the arcuate face. In this manner milk is allowed to flow through the apertures. The lower component has an upper section 52. The upper section is horizontally oriented above the open top of the glass. The upper section has an interior end 54. The interior end is formed as an extension of the hollow central section of the lower component. The upper section has an exterior end 56. The exterior end is adapted to be held in the lips of a user for sipping and drinking milk being received from the hollow segment of the lower section and the central section and the of the upper section of the lower component.

The upper component 32 has a central section 62. The central section is generally vertically disposed during operation and use. The upper component has a lower section 64. The lower section has semi-circular upper edges. The upper edges are formed of parallel side walls 66. The side walls have an open bottom 68. The side walls have a closed top. The closed top is formed of an arcuate face 70. The arcuate face couples the side walls. In this manner an upper chamber is formed. The upper section has an interior quadrant. The interior quadrant is formed as an extension of the central section. The upper section also has an exterior quadrant. The upper component has an upper section 72. The upper section is horizontally oriented above the upper component of the lower component, the open top of the glass. The upper section has an interior end 74. The interior end is formed as an extension of the central section of the upper component. The upper section further has an exterior end 76.

A hinge 34 is provided next. The hinge is secured between and rotatably couples the exterior quadrants of the lower and upper segments. In this manner the lower and upper chambers may be opened and separated for positioning the cookie therein and to thereby close and join the lower and upper chambers for securing a cookie in position between the upper and lower components.

Further provided are serrations 82, 84. The serrations simulate teeth. The teeth are formed in the open top of the lower component and the open bottom of the upper component. In addition, eyes 86 are formed in the upper component above the serrations. In this manner a visual appearance of a monster is given.

Provided last are positioning elements. The positioning elements include an upwardly extending lip. The upwardly extending lip assists a user in manipulating the lower and upper components. The positioning elements include a spherical member 92. The spherical member is provided at a central extent of the upper section of the lower component. In addition, a downwardly extending lip 94 is provided on the central section of the lower component is retained on the open top of the glass.

Figure 5:
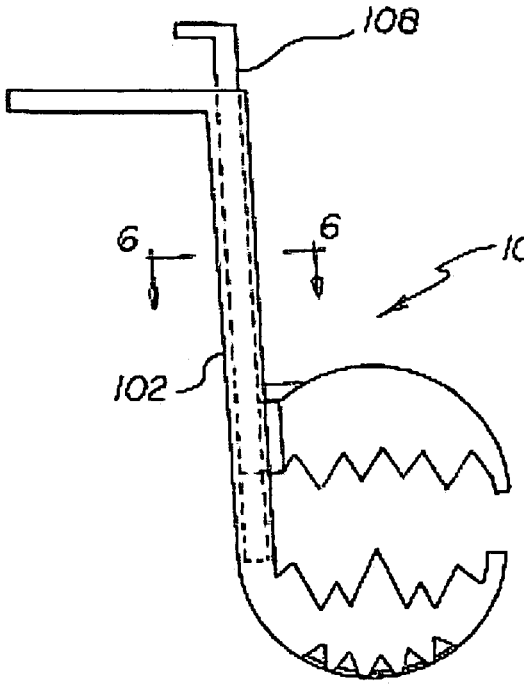
FIG. 5 is a side elevational view of a cookie support system constructed in accordance with an alternate embodiment of the invention.
Figure 6:
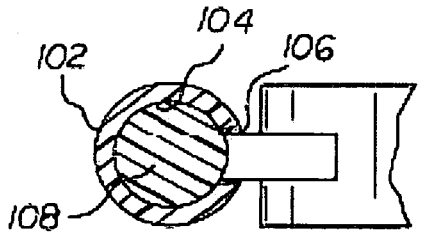
FIG. 6 is a cross sectional view of the system taken along line 6-6 of FIG. 5.

FIGS. 5 and 6 illustrate a system 100 constructed in accordance with an alternate embodiment of the invention. The central section 102 of the lower component includes a hollow extent 104 and a slot 106. A lower section is provided below.

An upper section is provided above. The central section 108 of the upper component is slidably received in the hollow extent. The lower component extends through the slot for sliding movement of the upper component with respect to the lower component to allow receiving and securing a cookie during operation and use.

Alternative embodiments of the present invention provide a cookie support system that includes a lower component, an upper component, and a coupling component. As used herein, the lower component is also referred to as the holding component, and the upper component is also referred to as the cover component. The following description is made with reference to the examples of cookie support system 10 shown in FIGS. 1-4 and cookie support system 100 shown in FIGS. 5 and 6.

For example, the lower component (holding component) 30 has an elongated first section 38 coupled with a curved second section 40 configured for receiving a cookie 26. In some embodiments, the elongated first section can have a hollow cylindrical portion, e.g., 38, configured for sipping a liquid by a user. In some embodiments, the hollow cylindrical portion can include a straw. In such embodiments, the lower component is configured to hold a straw. In another embodiment, a hollow segment 48 is provided. In still other embodiments, the lower component is configured to hold a straw. The lower component also has a second section 40 coupled to the first section 38. In some embodiments, the lower component has a curved second section. In an embodiment, second section 40 has parallel side walls 42 (shown in FIG. 4) with a top portion 44 (shown in FIG. 3) and a bottom portion configured for receiving a cookie. In an embodiment, the top portion is open, and the bottom portion formed of an arcuate face 46 coupling the side walls. In some embodiments, the lower component includes one or more apertures 50, which are configured to allow a liquid to flow there through.

In some embodiments, upper component (cover component) 32 has a curved first section 64 (shown in FIG. 3) having an arcuate face 70 configured for covering a top portion of a cookie, which may be held in the lower component. In other embodiments, upper component (cover component) 32 has a first section 64 (shown in FIG. 3) formed of parallel side walls 66 (shown in FIG. 4) with an open bottom portion 68 (shown in FIG. 3) and the top portion formed of arcuate face 70 coupling the side walls. Upper component (cover component) 32 also has a second section 62 (shown in FIG. 3) coupled to and protruding from first section 64. In some embodiment, second section 62 has an elongated shape, which can be, e.g., used by a user to manipulate the second section.

The cookie support system also has a coupling component between the lower and upper components configured to open and separate the lower and upper components for positioning a cookie there between. In some embodiments, the coupling component is configured to displace the cover component with respect to the holding component for positioning the cookie there between. In some embodiments, the coupling component is configured to rotatably couple the lower component and the upper component. For example, in the embodiment of FIGS. 1-4, the coupling component includes a hinge 34. In some other embodiments, the coupling component is configured to slidably couple the lower component and the upper component. An example is shown in the embodiment of FIGS. 5 and 6. In other embodiments, the coupling component is configured to allow at least a portion of the upper component to be slidably received in the lower component. In FIGS. 5 and 6, an elongated portion of the upper component (cover component) is slidably received in the lower (holding) component. In other embodiments, another portion of the upper component (cover component) can be slidably received in the lower (holding) component.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A cookie support system comprising:

a lower component, including:

an elongated first section having a hollow cylindrical portion configured for sipping a liquid by a user; and a second section coupled to the first section and having parallel side walls with an open top portion and a bottom portion configured for receiving a cookie, the bottom portion formed of an arcuate face coupling the side walls;

an upper component, including:

a first section formed of parallel side walls with an open bottom portion and a top portion formed of an arcuate face coupling the side walls; and an elongated second section coupled to and protruding from the first section; and a coupling component between the lower and upper components, configured to thereby open and separate the lower and upper components for positioning a cookie there between.

2. The system of claim 1, wherein the lower component comprises a straw.

3. The system of claim 1, wherein the lower component further comprises one or more apertures configured to allow the liquid to flow there through.

4. The system of claim 1, wherein the coupling component is configured to rotatably couple the lower component and the upper component.

5. The system of claim 1, wherein the coupling component comprises a hinge.

6. The system of claim 1, wherein the coupling component is configured to slidably couple the lower component and the upper component.

7. The system of claim 1, wherein the coupling component is configured to allow at least a portion of the upper component to be slidably received in the lower component.

8. A cookie support system comprising:

a holding component including:

an elongated first section coupled with a curved second section configured for receiving a cookie, the second section having parallel side walls with a bottom portion formed of an arcuate face coupling the side walls; and the second section further including one or more apertures;

a cover component including:

a curved first section having an arcuate face configured for covering a top portion of the cookie; and a second section coupled to and protruding from the curved first section; and a coupling component configured to displace the cover component with respect to the holding component for positioning the cookie there between, wherein the holding component further comprises a hollow cylindrical portion configured for sipping a liquid by a user.

9. The system of claim 8, wherein the holding component further comprises a straw.

10. The system of claim 8, wherein the holding component is configured to hold a straw.

11. The system of claim 8, wherein the one or more apertures in the holding component are configured to allow a liquid to flow there through.

12. The system of claim 8, wherein the cover component further comprises parallel side walls disposed on either sides of the arcuate face.

13. The system of claim 8, wherein the coupling component is configured to rotatably couple the holding component and the cover component.

14. The system of claim 8, wherein the coupling component comprises a hinge.

15. The system of claim 8, wherein the coupling component is configured to slidably couple the holding component and the cover component.

16. The system of claim 8, wherein the coupling component is configured to allow at least a portion of the cover component to be slidably received in the holding component.

17. A cookie support assembly, comprising:

a lower component;

an upper component; and a hinge coupling between the upper component and the lower component;

the lower component having a central section including a portion in a hollow cylindrical configuration generally vertically disposed during operation and use;

the lower component having a lower section with semicircular lower edge formed of parallel side walls with an open top and a bottom formed of an arcuate face coupling the side walls to form a lower chamber, the lower section having one or more apertures to allow a liquid to flow there through;

the lower component having an upper section with an exterior end adapted to be held in the lips of a user for sipping and drinking the liquid;

the upper component having a first section generally vertically disposed during operation and use;

the upper component having a second section with semicircular upper edges formed of parallel side walls with an open bottom and a closed top formed of an arcuate face coupling the side walls to form an upper chamber; and the hinge secured between and rotatably coupling the lower and upper components to thereby open and separate the lower and upper chambers for positioning a cookie therein and to thereby close and join the lower and upper chambers for securing a cookie in position between the upper and lower components.

* * * * *